United States Patent [19]

Casdas

[11] Patent Number: 4,490,233

[45] Date of Patent: Dec. 25, 1984

[54] PROCESS FOR THERMALLY INSULATING PRECALCINED ANODES IN ELECTROLYSIS CELLS FOR THE PRODUCTION OF ALUMINUM

[75] Inventor: Spyridon Casdas, Beotie, Greece

[73] Assignee: Aluminium de Grece, Beotie, Greece

[21] Appl. No.: 490,878

[22] Filed: May 2, 1983

[30] Foreign Application Priority Data

May 18, 1982 [FR] France ..... 82 08978

[51] Int. Cl.[3] ..... C25C 3/12

[52] U.S. Cl. ..... 204/290 R; 204/67; 204/245

[58] Field of Search ..... 204/245, 290 R, 67

[56] References Cited

U.S. PATENT DOCUMENTS 3,453,199 7/1969 Fricker ..... 204/290 R 3,829,374 8/1974 Kugler et al. ..... 204/290 R 4,172,023 10/1979 Friedli et al. ..... 204/294

*Primary Examiner*—Howard S. Williams

*Attorney, Agent, or Firm*—Dennison, Meserole, Pollack & Scheiner

[57] ABSTRACT

The invention relates to a process for thermally insulating precalcined anodes in cells for the production of aluminum by the electrolysis of alumina dissolved in an electrolysis bath based on molten cryolite, comprising covering the upper part of the anodes with a heat-insulating layer of alumina and/or ground electrolysis bath, in which process a strip of aluminum substantially equal in height to the heat-insulating layer is applied to the upper part of the anode and over its entire periphery.

To facilitate positioning of the strip, a ledge to which the strip is applied is formed around the periphery of the anode.

5 Claims, 6 Drawing Figures

PROCESS FOR THERMALLY INSULATING PRECALCINED ANODES IN ELECTROLYSIS CELLS FOR THE PRODUCTION OF ALUMINUM

This invention relates to a process for thermally insulating precalcined anodes in cells for the production of aluminum by the electrolysis of alumina dissolved in molten cryolite using the Hall-Heroult process.

Reducing the consumption of electricity in electrolysis cells requires inter alia a reduction in the heat losses and, in particular, in the heat losses through the anodes which may be estimated at approximately 25% of the total heat losses.

In modern precalcined-anode cells supplied continuously and punctually with alumina, this heat insulation is essential because it enables the optimal form of the talus, i.e. the layer of electrolyte solidified on the lateral walls of the crucible, to be obtained which is essential if the cells are to operate efficiently for long periods.

Hitherto, it has been standard practice to cover the anodes with alumina or with recovered and ground electrolysis bath.

If this method is to be effective, the alumina or the bath has to be directly applied to the anode, i.e. the anode cannot be subjected to the metallization—by spraying with aluminum—normally used for protecting the upper part of the anode against combustion by the surrounding air. Accordingly, the layer of alumina or ground bath performs a dual role, namely thermal insulation and protection of the anode.

However, for the first few days after the installation of a new anode, it is difficult to maintain a sufficiently thick layer of alumina or ground bath because the projecting part of the anode is still large and its shape has been designated with the upper angles blunted to facilitate removal and recovery of the solidified bath when the anode is withdrawn from the cell at the end of its useful life.

The present invention relates to a process which facilitates thermal insulation of the anodes with alumina and/or ground bath irrespective of the projecting height, i.e. the working age of the anode and which does not interefere with its subsequent cleaning.

The process according to the invention comprises applying a strip of aluminum to the periphery of the anode to form a barrier which enables a heat-insulating layer (alumina and/or ground bath) to be maintained on top of the anode.

THE DRAWINGS

FIG. 1, which relates to the prior art, is a vertical section through a precalcined anode having four suspension rods.

DETAILED DESCRIPTION OF THE INVENTION

Figure 1:
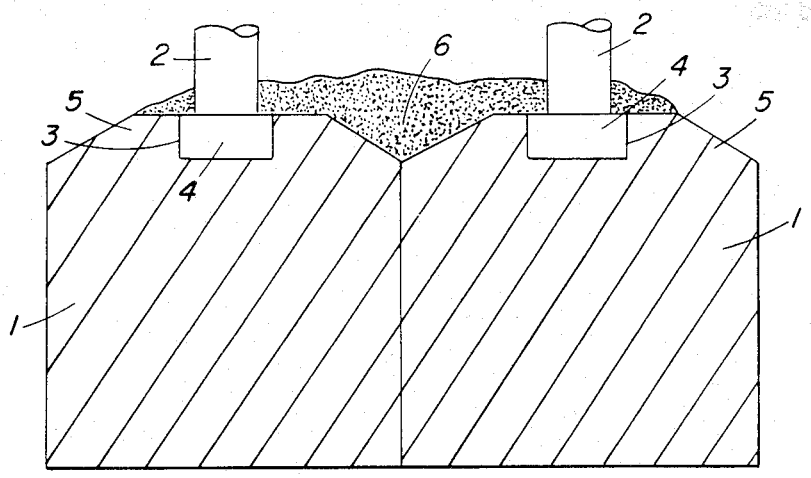
PRIOR ART FIG. 1

The anode is formed by the actual carbon block 1 and the suspension rods 2 sealed in the cavities 3 by cast iron 4.

The angles of the upper edge 5 of the anode are sloped or blunted to facilitate the subsequent removal of electrolysis bath which has collected on top of the anode and between the rods before the rods are loosened and the various components (cast iron, carbon, rods, electrolyte) recovered.

In the conventional arrangement (FIG. 1), the heat-insulating layer is not retained because of the inclination of the edge 5 and the heat insulation limited to the central part 6 is very inadequate.

Figure 2A:
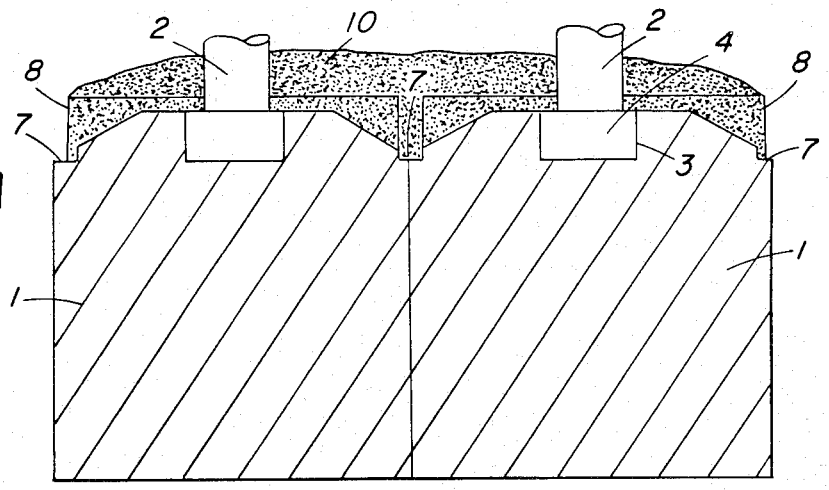
FIG. 2 is a vertical section A through a plan view B of an anode modified in accordance with the invention.
Figure 2B:
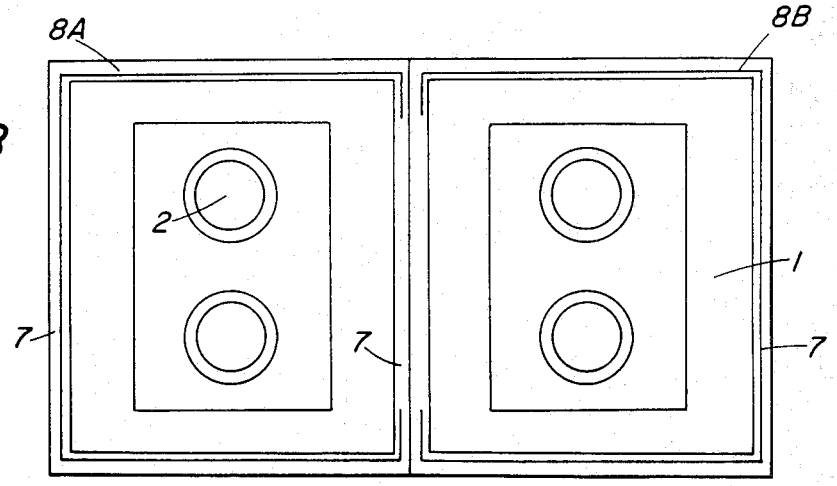

According to the present invention, the shape of the anode is modified during molding of the carbon paste to produce a peripheral ledge 7, see FIG. 2. A strip of aluminum 8, approximately 10 centimeters in height, is applied to this ledge and extends over the entire upper periphery of the anode. It is also possible to provide the ledge 7 with a groove in which the strip of aluminum would engage. In practice, however, this would complicate molding of the anode without affording any particular advantages over the plain flat ledge.

To facilitate its application, the strip of aluminum preferably consists of two prefabricated parts 8A and 8B which are simply applied to the two anode halves.

Figure 3:
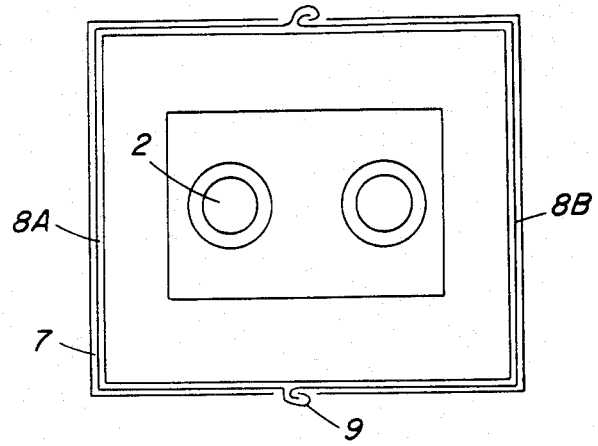
FIGS. 3, 4 and 5 show an embodiment of the invention adapted for smaller anodes (FIG. 3) or for elongate anodes (FIGS. 4 and 5).
Figure 4:
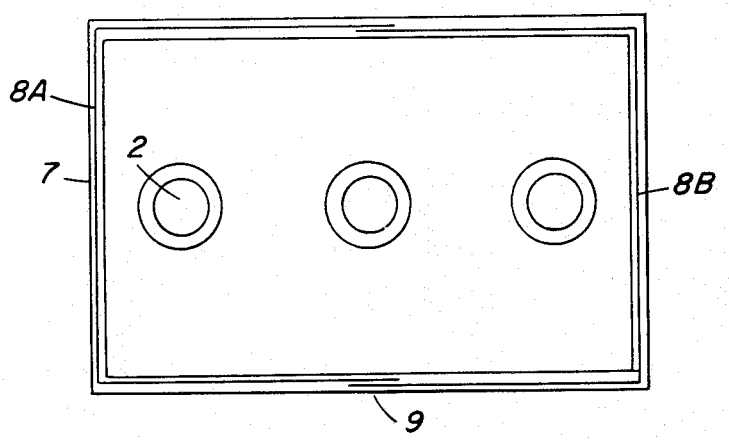
Figure 5:
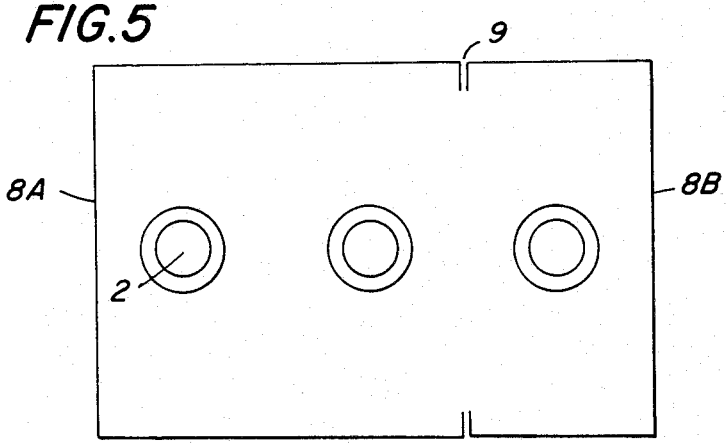

In the case of small anodes (FIG. 3) or elongate anodes, the strip of aluminum likewise consists of two parts 8A and 8B provided at their ends with interlocking flanges or with any other equivalent means providing for rapid locking. The point of connection between the two parts 8A and 8B is located at the most suitable place for the positioning operation and it is not necessary for the two parts 8A and 8B to be identical in dimensions, particularly if the connections 9 are desired to extend to that surface of the anodes which faces towards the outside of the cell (cf. FIG. 5).

As the anode wears and descends, the strip of aluminum enters zones of increasing temperature and finishes by progressively melting. In the meantime, however, the alumina and/or the ground bath have lost their fluidity and undergo a kind of sintering although they remain in place on the anode until the end of its useful life and ensure satisfactory heat insulation 10.

I claim:

1. A process for thermally insulating a precalcined anode in a cell for the production of aluminum by the electrolysis of alumina dissolved in an electrolysis bath based on molten cryolite, the edges of the top surface of said anode being sloped downwardly to join the side walls of said anode at its upper periphery, comprising (1) applying to said anode from a point adjacent the juncture of the sloped portion and side walls, and over its entire upper periphery, a strip of aluminum extending upwardly, and (2) covering the top-surface of said anode with a layer of alumina and/or ground electrolysis bath of sufficient thickness at all points to serve a heat insulating function, wherein the height of said aluminum strip is substantially the same as the desired thickness of said layer over the portion of the top surface which is sloped.

2. A process as defined in claim 1, wherein a ledge to which said strip of aluminum is applied is formed around the upper periphery of the anode at the top of its side walls.

3. A process as defined in claim 2, wherein a groove in which the aluminum strip engages is formed in said ledge.

4. A process as defined in claim 1, wherein the strip of aluminum consists of at least two parts which cooperate through interlocking means to form a substantially continuous peripheral strip.

5. A process as defined in claim 1, wherein the height of said aluminum strip is about 10 cm.

* * * * *